US005857785A

United States Patent [19]

Fujii

[11] Patent Number: 5,857,785

[45] Date of Patent: Jan. 12, 1999

[54] LABEL PRINTING APPARATUS

[75] Inventor: Keisuke Fujii, Osaka, Japan

[73] Assignee: Fujicopian Co., Ltd., Japan

[21] Appl. No.: 997,273

[22] Filed: Dec. 23, 1997

[30] Foreign Application Priority Data

Dec. 27, 1996 [JP] Japan ..... 8-349881

[51] Int. Cl.[6] ..... B41J 33/14

[52] U.S. Cl. ..... 400/223; 400/248; 156/387; 156/540

[58] Field of Search ..... 400/223, 248, 400/636, 634, 615.2; 156/387, 247, 540

[56] References Cited

U.S. PATENT DOCUMENTS

| | | | |
|---|---|---|---|
| 5,009,530 | 4/1991 | Kuzuya et al. | 400/188 |
| 5,738,748 | 4/1998 | Michell | 156/247 |

FOREIGN PATENT DOCUMENTS

| | | | |
|---|---|---|---|
| 566161 | 10/1993 | European Pat. Off. | 400/223 |
| 363242579 | 10/1988 | Japan | 400/223 |
| 404344276 | 11/1992 | Japan | 400/223 |
| 8160861 | 12/1996 | Japan . | |

*Primary Examiner*—Edgar Burr
*Assistant Examiner*—Anthony H. Nguyen
*Attorney, Agent, or Firm*—Webb Ziesenheim Bruening Logsdon Orkin & Hanson, P.C.

[57] ABSTRACT

A label printing apparatus includes a printing unit for printing an image on a front surface of a label tape having a back surface bearing an adhesive layer via an ink ribbon having a back surface bearing a removal layer. The apparatus further includes a superposed-travelling guiding mechanism for guiding traveling of the label tape and the used label tape together, with the removal layer of the ink ribbon being contacted with and superposed on the adhesive layer of the label tape.

8 Claims, 3 Drawing Sheets

LABEL PRINTING APPARATUS

BACKGROUND OF THE INVENTION

1. Field of the Invention

The present invention relates to a label printing apparatus, and more particularly to a label printing apparatus including a printing means for printing an image such as a character, a mark, a graphic image or the like on a front surface of a label tape having a back surface bearing an adhesive layer via ink ribbon having a back surface bearing a removal layer.

2. Description of the Related Art

Conventionally, a label printing apparatus of the above-noted type includes a printing head and a platen roller together constituting the printing means. The apparatus further includes a tape feed core which winds thereabout a label tape and an ink ribbon, with a surface of the former being placed in contact with a surface of the latter, and a ribbon take-up core for taking up the used ribbon removed from the label tape after the printing operation (see Japanese laid-open patent gazette Hei. 8(1996)-160861 for instance).

In the above apparatus, a removal layer is formed, by e.g. the well-known Teflon™ coating treatment, on the outer peripheral face of the platen roller, so as to prevent the adhesive face of the adhesive layer of the label tape from un-removably adhering to the outer peripheral face of the platen roller.

With the above-described conventional apparatus, no removable paper is affixed to the adhesive layer of the label tape. Then, the manufacture cost of the label tape may be reduced by an amount corresponding to the cost of such removable paper. In addition, a desired printing portion of the used label tape after the printing operation may be affixed to a predetermined target surface. However, the used label tape may be accidentally bent, leading to mutual adhesion between adjacent adhesive layer portions thereof, or the adhesive layer may be adhered to a certain object when the desired printing portion is cut off the tape and is transported to another place. In such case, great trouble is required for removing the layer. Moreover, if the adhesive layer is torn off or if a wrinkle is developed in the label tape during the removal, another printing operation becomes necessary. Hence, handling of the used label tape after a printing operation requires a significant care.

The present invention attends to the above-described drawbacks of the conventional art. A primary object of the invention is to provide an improved label printing apparatus which enables reduction in the manufacture cost of the label tape, restricts occurrence of accidental adhesion of the used label tape and facilitates the handling of the used label tape.

SUMMARY OF THE INVENTION

For accomplishing the above-noted object, a label printing apparatus, according to the present invention, comprises:

printing means for printing an image on a front surface of a label tape having a back surface bearing an adhesive layer via an ink ribbon having a back surface bearing a removal layer; and superposed-traveling guiding means for guiding traveling of the label tape and the used label tape together, with the removal layer of the ink ribbon being contacted with and superposed on the adhesive layer of the label tape.

With the above feature, the exposed adhesive layer of the used label tape may be covered by using the used ink ribbon. Moreover, as the removal layer of the used ink ribbon is placed in contact with the adhesive layer of the label tape, the used ribbon may be easily removed from the adhesive layer of the label tape, when this used label tape is to be affixed to a predetermined target surface.

Therefore, for the reduction in the manufacture cost of the label tape, the apparatus of the invention allows use of the label tape having no removable paper on the adhesive layer formed on the back surface thereof. Besides, the apparatus avoids the trouble of mutual adhesion between adhesive layer portions of the used label tape or accidental adhesion of the adhesive layer to an object during transportation of the used label tape, by effectively utilizing the used ink ribbon which is to be disposed of originally. Hence, the apparatus facilitates the handling of the used label tape, while achieving the cost reduction.

Moreover, since the used ink ribbon is affixed to the adhesive layer of the used label tape after a printing operation, the apparatus does not require the ribbon take-up core for taking up the used ink ribbon. Thus, the construction of the entire label printing apparatus may be formed simple and compact.

According to a further feature of the present invention, the label tape and the ink ribbon are wound together about a tape feed core, with the surface of the label tape and the surface of the ink ribbon being contacted to and superposed on each other; and the label tape and the ink ribbon are separated from each other after passage thereof through the printing means.

In the case of the above-described construction, the label tape and the ink ribbon are fed together from the tape feed core. Hence, there is no necessity of providing a ribbon feed core dedicated to feeding of the ink ribbon. As a result, the construction of the entire label printing apparatus may be formed even more simple and compact.

According to a still further feature of the present invention, a position at which the superposed-traveling guiding means starts causing the label tape and the ink ribbon to coming into contact with each other is set upstream of the printing means in the travelling direction of the label tape.

With the above feature, the adhesive layer of the label tape may be covered with the used ink ribbon from the position upstream of the printing means. This arrangement can effectively prevent the adhesive layer of the label tape from coming into contact with a travelling guide member such as a platen roller constituting the printing means, which member is disposed downstream of the contact start position. Then, in comparison with a construction in which the contact start position is set downstream of the printing means in the travelling direction of the tape, the above arrangement makes it possible to reduce the number of travelling guide members on whose surfaces there need to be provided removal layers adapted for preventing accidental adhesion of the label tape. As a result, the manufacture cost of the entire label printing apparatus may be reduced, by an amount corresponding to that of such removal layers.

Further and other objects, features and advantages of the invention will become apparent from the following detailed description of the preferred embodiments thereof with reference to the accompanying drawings.

DESCRIPTION OF THE PREFERRED EMBODIMENTS

Preferred embodiments of the present invention will now be described in details with reference to the accompanying drawings.

[first embodiment]

Figure 1:
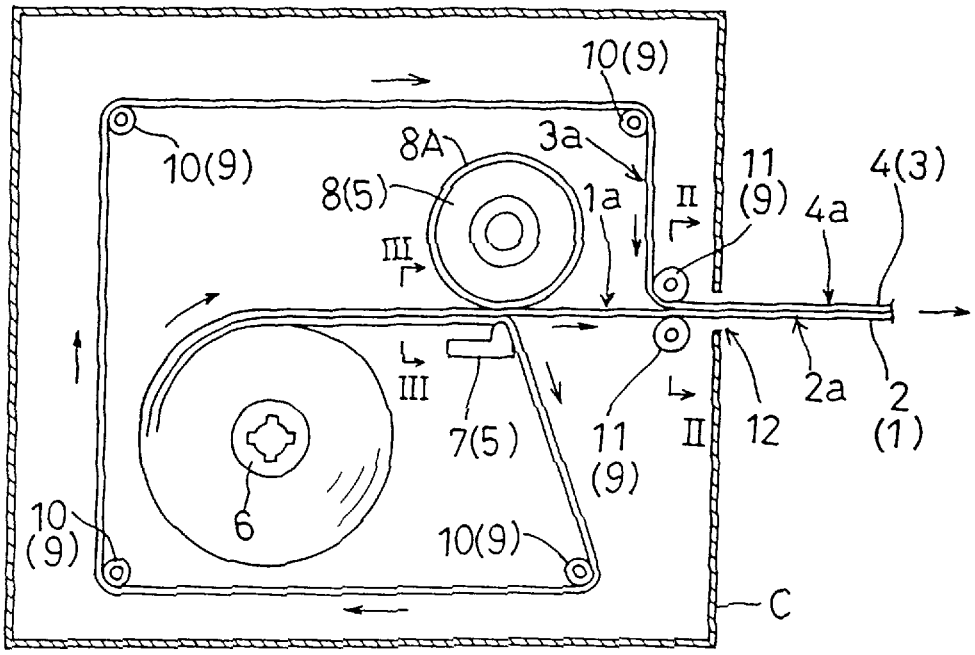
FIG. 1 is a plan view showing a label printing apparatus according to a first preferred embodiment of the invention.
Figure 2:
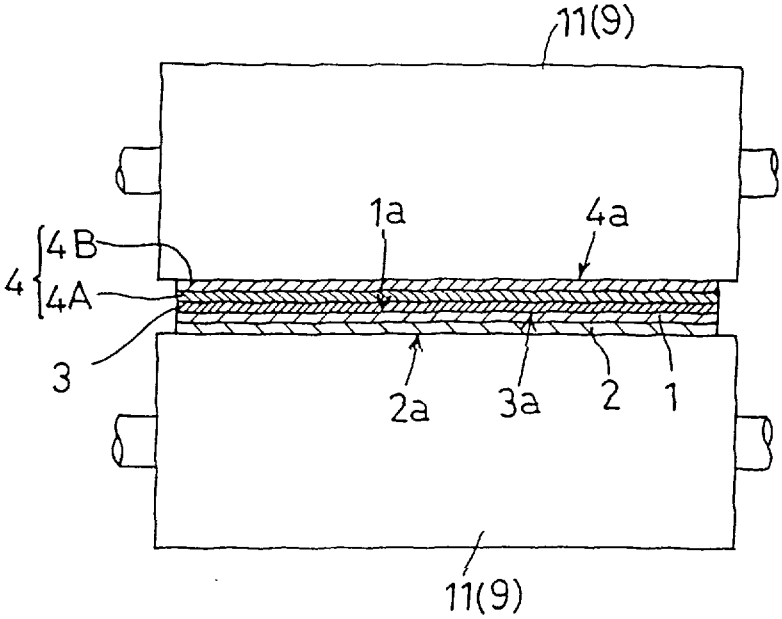
FIG. 2 is an enlarged section taken along a line II—II in FIG. 1.
Figure 3:
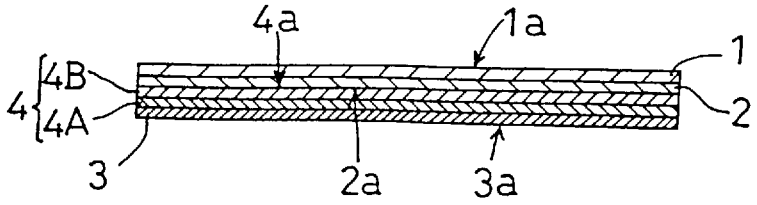
FIG. 3 is an enlarged section taken along a line III—III in FIG. 1.

FIGS. 1–3 show a label printing apparatus relating to the first preferred embodiment of the present invention. This label printing apparatus includes a printing means 5 for printing an image (character, numeral, mark, graphic image or the like) on a front surface of a label tape 2 having, on a back surface thereof, an adhesive layer 1 formed by application of adhesive agent thereto, via an ink ribbon 4 having, on a back surface thereof, a removal layer 3 formed by application of mold-removing agent such as of silicone thereto. The label printing apparatus further includes a cylindrical tape feed core 6 about which the label tape 2 and the ink ribbon 4 are wound with a surface 2*a* of the tape 2 being contacted with and superposed on a surface 4*a* of the ink ribbon 4 and with the adhesive layer 1 of the label tape 2 being oriented radially outward, a printing head 7 and a platen roller 8 which together provide the printing means 5, and a superposed-travelling guiding means 9 which guides travelling of the used label tape 2 and the used ink ribbon 4 after a printing operation through the printing head 7 in such a manner that a removal face 3*a* of the removal layer 3 of the used ink ribbon 4 is superposed on and contacted with an adhesive face 1*a* of the adhesive layer 1 of the used ink ribbon 2.

The adhesive face 1*a* of the adhesive layer 1 of the label tape 2 is placed in contact with the outer peripheral face of the platen roller 8. Then, as this platen roller 8 is driven to rotate, the label tape 2 and the ink ribbon 4 are fed in the superposed state from the tape feed core 6 to travel between the printing head 7 and the platen roller 8.

Incidentally, when the label tape 2 and the ink ribbon 4 are wound in the superposed state about the tape feed core 6, the adhesive face 1*a* of the adhesive layer 1 of the label tape 2 is brought into contact with the removal face 3*a* of the removal layer 3 of the ink ribbon 4 radially adjacent thereto. Therefore, the ink ribbon 4 may be readily removed from the adhesive face 1*a* of the adhesive layer 1 of the label tape 2, so that the label tape 2 and the ink ribbon 4 may be smoothly fed from the tape feed core 6.

On the outer peripheral face of the platen roller 8, there is formed a removal layer 8A by means of the well-known Teflon™ coating treatment. Thus, the adhesive face 1*a* of the adhesive layer 1 of the label tape 2 will not non-removably affixed to this outer peripheral face of the platen roller 8.

As shown in FIGS. 1–3, in this embodiment, the ink ribbon 4 comprises a thermal ink ribbon including a base film 4A and an ink layer 4B formed on one side of the film 4A by applying thermal transfer ink thereto. The surface of this ink layer 4B provides a surface 4*a* of the ink ribbon 4.

When the printing head 7 is activated, the label tape 2 and the ink ribbon 4 superposed thereon are together pinched between this printing head 7 and the platen roller 8. With this, the thermal transfer ink of the ink layer 4B of the ink ribbon 4 is transferred to form a printed image on to the surface 2*a* of the label tape 2 located between the printing head 7 and the platen roller 8. After the passage between the printing head 7 and the platen roller 8, the used label tape 2 and the used ink ribbon 4 which were superposed on each other are now separated from each other as they are being guided along separate, i.e. branched travelling paths.

As shown in FIG. 1, the superposed-travelling guiding means 9 includes a plurality of guide rollers 10 for causing the used ink ribbon 4 separated from the used label tape 2 to make a detour about the outer periphery of the tape feed core 6 winding the label tape 2 and the ink ribbon 4 thereabout from the surface 2*a* of the label tape 2 toward the adhesive face 1*a* of the adhesive layer 1 of the used label tape located downstream of the printing means 5 in the tape travelling direction, and a pair of merging rollers 11 disposed downstream of the printing means 5 at a position where the used label tape 2 and the used ink ribbon 4 are brought into contact and merged with each other.

Then, the used label tape 2 and the used ink ribbon 4 having been guided by the guide rollers 10 are guided and merged with each other by the pair of merging rollers 11, so that the tape 2 and the ribbon 4 are fed downstream in the superposed condition with the removal face 3*a* of the removal layer 3 of the ink ribbon 4 being superposed and contacted with the adhesive face 1*a* of the adhesive layer 1 of the label tape 2.

The merging rollers 11 are associated with the platen roller 8 via an appropriate transmission mechanism (not shown) such as a belt or gear transmission, so that the merging rollers 11 may be driven to rotate in a same peripheral velocity as this platen roller 8.

As shown in FIG. 1, the label printing apparatus of this embodiment includes the tape feed core 6 about which the label tape 2 and the ink ribbon 4 are wound, the printing head 7 and the platen roller 8 together constituting the printing means 5, and the plurality of guide rollers 10 and the pair of merging rollers 11 which together constitute the superposed-travelling guiding means. And, all of these components are enclosed within a casing C which forms the outer shell of this label printing apparatus. Then, the printed label tape 2 together with the used ribbon 4 superposed and affixed via the removal face 3*a* of the removal layer 3 on the adhesive face 1*a* of the label tape 2 is fed to the outside through a tape exit opening 12 defined in the casing C.

Figure 4:
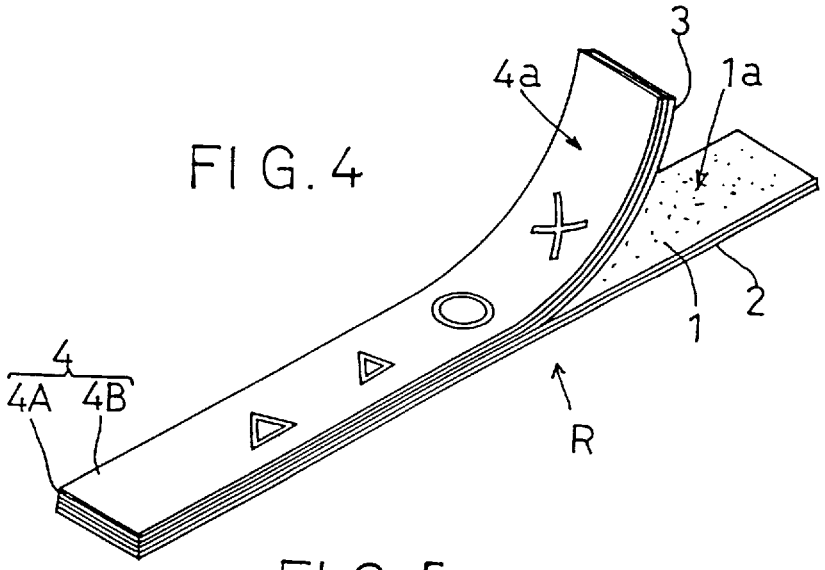
FIG. 4 is a perspective view showing a label.

Then, as shown in FIG. 4, a cutting tool such as a cutter, a pair of scissors or the like attached to the casing C is used for cutting off a desired printed portion of the printed label tape fed to the outside through the tape exit opening 12, with the used ink ribbon 4 affixed thereto, whereby a label R, as a separate piece, is obtained. In this label R, the adhesive face 1*a* of the adhesive layer 1 formed on the back side thereof is covered with the used ink ribbon 4.

Accordingly, when this label R is to be affixed to a certain target surface, the removal face 3*a* of the removal layer 3 of the used ink ribbon 4 is kept in contact with the adhesive face 1*a* of the adhesive layer 1 of the label tape 2. So that, the used ink ribbon 4 may be readily removed from the label R and after removing this used ink ribbon 4, the label R may be directly affixed to the target surface.

Incidentally, in FIG. 4, the design pattern formed on the surface of the ink layer 4B of the used ink ribbon 4 is a 'cast-off' remainder of the thermal transfer tape which was used for the image printing.

[second embodiment]

Figure 5:
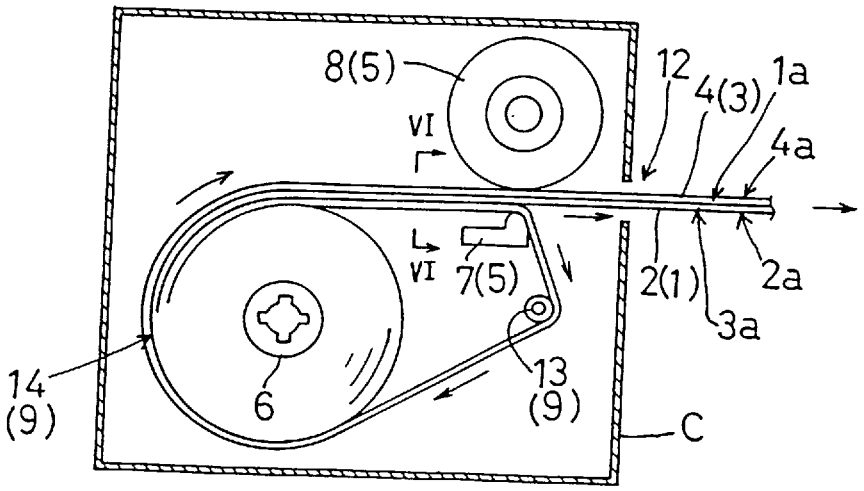
FIG. 5 is a plan view showing a label printing apparatus according to a second preferred embodiment of the invention.
Figure 6:
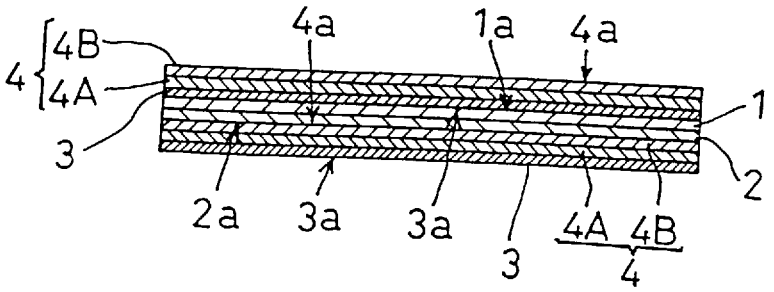
FIG. 6 is an enlarged section taken along a line VI—VI in FIG. 5.

FIGS. 5 and 6 show a label printing apparatus relating to a second embodiment of the present invention. This label printing apparatus includes a cylindrical tape feed core 6 about which the label tape 2 and the ink ribbon 4 are wound with the surface 2*a* of the tape 2 being contacted with and superposed on the surface 4*a* of the ink ribbon 4 and with the adhesive layer 1 of the label tape 2 being oriented radially outward, a printing head 7 and a platen roller 8 which together provide the printing means 5, and a superposed-travelling guiding means 9 for guiding travelling of the used label tape 2 and the used ink ribbon 4 which are located upstream of the printing means 5 in the tape traveling direction in such a manner that the removal face 3*a* of the removal layer 3 of the used ink ribbon 4 is superposed on and contacted with the adhesive face 1*a* of the adhesive layer 1 of the used label tape 2.

In this embodiment, the superposed-travelling guiding means 9 includes a guide roller 13 for guiding the used and separated ink ribbon 4 past between the printing head 7 and the platen roller 8 constituting the printing means 5 toward an outermost peripheral face 14 of the label tape 2 and the ink ribbon 4 together wound about the tape feed core 6 and this outermost peripheral face 14. In operation, the removal face 3*a* of the removal layer 3 of the used ink ribbon 4 guided by the guide roller 13 is wound superposed on and affixed to the adhesive face 1*a* of the adhesive layer 1 of the label tape 2 located on the outermost peripheral face 14.

That is to say, the position where the superposed-travelling guiding means 9 starts contacting the label tape 2 with the used ink ribbon 4 is set upstream of the printing means 5 in the tape traveling direction. As shown in FIG. 6, the label tape 2 fed from the tape feed core 6 is advanced toward the printing means 5 while the tape 2 is bound between the un-used ink ribbon 4 and the used ink ribbon 4. Thus, the surface 4*a* of the used ink ribbon 4 superposed on the label tape 2 is contacted with the outer peripheral face of the platen roller 8, and in association with driven rotation of this platen roller 8, the ink ribbon 4 and the label tape 2 wound about the tape feed core 6, together with the used ink ribbon 4, are fed under the mutually superposed condition and advanced between the printing head 7 and the platen roller 8.

Accordingly, the adhesive face 1*a* of the label tape 2 is not contacted with the outer peripheral face of the platen roller 8. Then, there is no necessity of forming, by e.g. the Teflon™ coating, the removal layer 8A on the outer peripheral face of the platen roller 8.

With the driven rotation of the platen roller 8, the used label tape 2 after the printing in which the used ink ribbon, via the removal face 3*a* of the removal layer 3 thereof, is superposed and affixed on the adhesive face 1*a* of the adhesive layer 1 of the label tape 2, is fed to the outside through the tape exit opening 12 provided in the casing C.

The remaining portions of the construction of this embodiment are identical to those of the first embodiment described hereinbefore; and those like portions or elements are denoted with like reference marks or numerals and will not be described in repetition.

[third embodiment]

Figure 7:
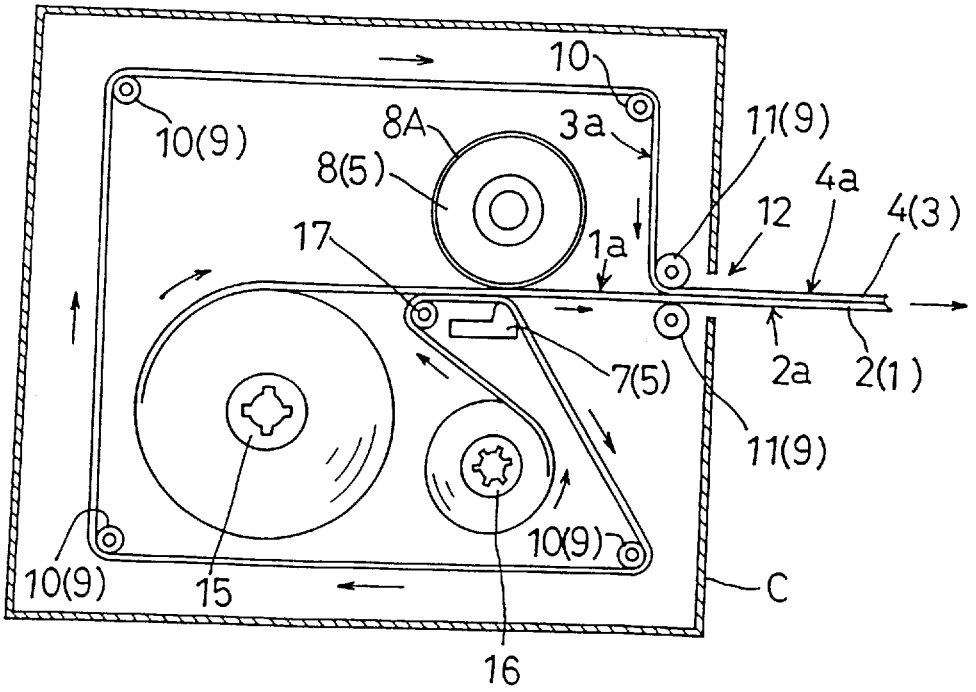
FIG. 7 is a plan view showing a label printing apparatus according to a third preferred embodiment of the invention.

FIG. 7 shows a label printing apparatus relating to a third embodiment of the present invention. In this apparatus, in addition to a tape feed core 15 winding the label tape 2 thereabout, there is separately provided a ribbon feed core 16 winding the ink ribbon 4 thereabout. The label tape 2 fed from the tape feed core 15 and the ink ribbon 4 fed from the ribbon feed core 16 are guided in a superposed condition where the surface 2*a* of the label tape 2 is superposed on and contacted with the surface 4*a* of the ink ribbon 4, until the tape 2 and the ribbon 4 reach the gap between the printing head 7 and the platen roller 8 constituting the printing means 5.

The remaining portions of the construction of this embodiment are identical to those of the first embodiment described hereinbefore; and those like portions or elements are denoted with like reference marks or numerals and will not be described in repetition.

[other embodiments]

(1) In the respective embodiments described above, the ink ribbon 4 comprises a thermal transfer ribbon including the base film 4A and the thermal transfer ink layer 4B formed on one side of the base film. The type of the ink ribbon is not limited thereto. Instead, the ink ribbon may be of a type comprised of a base ribbon impregnated with pressure-sensitive ink.

(2) In the respective embodiments described above, the components constituting the label printing apparatus are all enclosed within the casing C. Instead, with the printing means 5 along being enclosed within the casing C, the other components may be accommodated within a cassette case detachably attachable to the casing C.

The present invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A label printing apparatus for use with a label tape having a front surface and a back surface, the back surface comprising an adhesive layer and an ink ribbon having a front surface for contacting the front surface of the label tape and a back surface comprising a removal layer, the apparatus comprising:

a printing means for printing an image on the front surface of the label tape through contact between the front surface of the label tape and the front surface of the ink ribbon to form a used label tape and a used ink ribbon; and a superposed-traveling guiding means for guiding traveling of the label tape and the used ink ribbon together, and wherein the removal layer of the used ink ribbon is contacted with and superposed on the adhesive layer of the used label tape.

2. The label printing apparatus according to claim 1, further comprising a tape feed core, whereon the label tape and the ink ribbon are wound together such that the front surface of the label tape is removably contacted with and superposed upon the front surface of the ink ribbon and such that the label tape and the ink ribbon are separable after passage thereof through the printing means.

3. The label printing apparatus according to claim 1, wherein the superposed-traveling guiding means is set upstream of the printing means in the traveling direction of the label tape.

4. The label printing apparatus according to claim 2, wherein the printing means is comprised of a printing head and a platen roller.

5. The label printing apparatus according to claim 4, wherein the superposed-traveling guiding means comprises a plurality of guide rollers for guiding traveling of the used ink ribbon separably from the used from the used label tape and about the outer periphery of the tape feed core, wherein the first of the plurality of guide rollers is located downstream of the printing means in the tape traveling direction, and wherein a pair of merging rollers is disposed downstream of the first of the plurality of guide rollers for contacting and merging together the adhesive layer of the used label tape and the removal layer of the used ink ribbon.

6. The label printing apparatus according to claim 5, wherein the ink ribbon is comprised of an ink layer applied with thermo-sensitive transfer ink.

7. The label printing apparatus according to claim 5, further comprising a transmission means for associating the merging rollers with the platen roller so that the merging rollers and the platen roller are driven to rotate at the same peripheral velocity.

8. The label printing apparatus according to claim 1, further comprising:

a tape feed core winding the label tape thereabout; and a ribbon feed core winding the ink ribbon thereabout, wherein the label tape fed from the tape feed core and the ink ribbon fed from the ribbon feed core are guided to superpose and contact the front surface of the label tape with the front surface of the ink ribbon, and wherein the printing means is comprised of a printing head and a platen roller disposed oppositely such that a gap is formed therebetween for receiving the label tape superposed and contacted with the ink ribbon.

* * * * *